United States Patent [19]

Barker

[11] 4,265,261

[45] May 5, 1981

[54] TENT

[76] Inventor: Joseph K. Barker, Rte. 7, Box 111, Abingdon, Va. 24210

[21] Appl. No.: 102,110

[22] Filed: Dec. 7, 1979

[51] Int. Cl.[3] ..... A45F 1/16

[52] U.S. Cl. ..... 135/3 R; 135/14 V; 135/15 PQ; 135/1 C

[58] Field of Search ..... 135/3 R, 1 R, 14 V, 135/15 PE, 1 C, 15 R, 15 PQ

[56] References Cited

U.S. PATENT DOCUMENTS

| | | | |
|---|---|---|---|
| 359,796 | 3/1887 | Lewis | 135/14 V |
| 779,500 | 1/1905 | Rice | 135/1 C |
| 2,230,454 | 2/1941 | Friesner | 135/14 |
| 2,442,132 | 5/1948 | Laythe | 135/1R |
| 3,052,249 | 9/1962 | Seaman | 135/3 R |
| 3,461,890 | 8/1969 | Goodrich | 135/1 R |

*Primary Examiner*—Reinaldo P. Machado
*Attorney, Agent, or Firm*—Nathaniel A. Humphries

[57] ABSTRACT

A tent is disclosed for sunbathing, camping, hunting and the like, which includes a flexible square floor panel, flexible triangular side walls with each side wall having a lower edge attached to the edge of the floor panel and edges of adjacent side walls attached together to form an apex at the upper end thereof, and a support structure including telescoping rod members positionable within the shelter along the adjoining edges of the side walls and a plastic apex member positionable in the apex formed by the side walls and having downwardly and outwardly facing flexible coils therein to receive the upper ends of the telescoping members when the telescoping members are extended from the lower end of the adjoining edges to the apex member to provide rigid support for the flexible side walls of the tent. A bulbous ended plug in the lower end of each rod has a bore through which a tie-down cord extends and is held in place by a knot on its inner end; the tie-down cord extends externally of the tent through a sealed floor corner opening in the tent. Triangular side panels adjacent a window include stiffeners connectable at their outer ends to define an awning shaped like the corner of a pyramid awning over the window.

8 Claims, 4 Drawing Figures

FIG-2
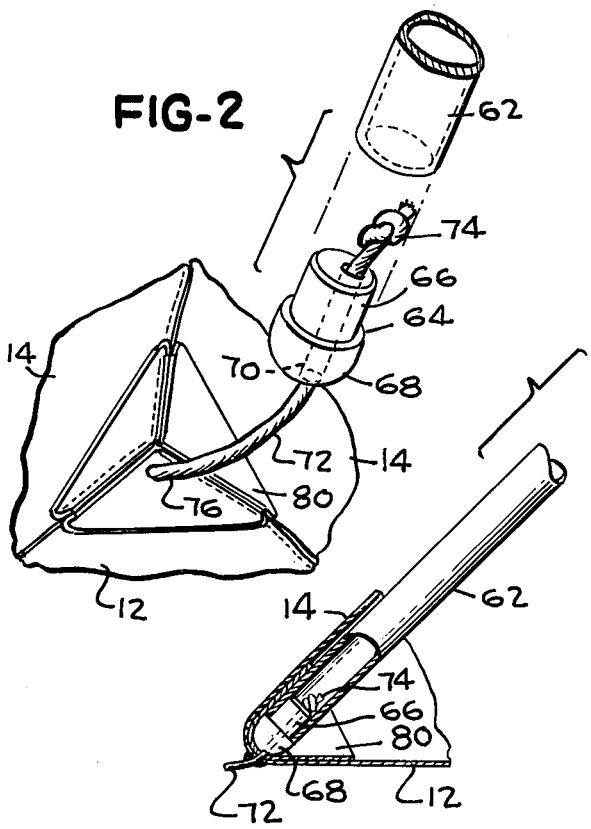
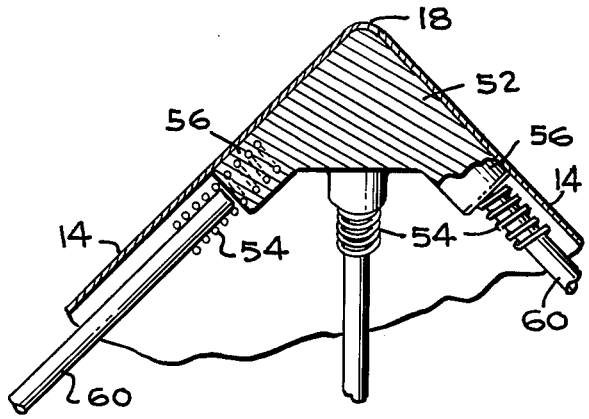
FIG-3
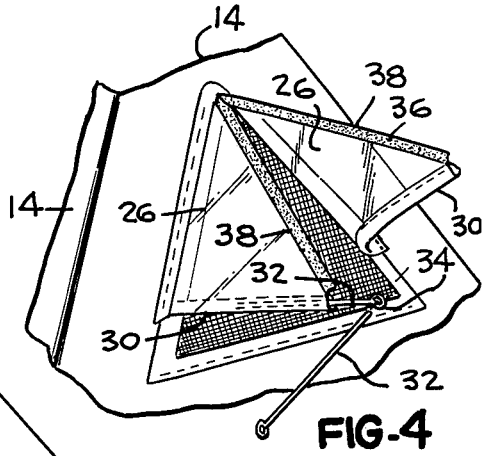
FIG-4
FIG-1
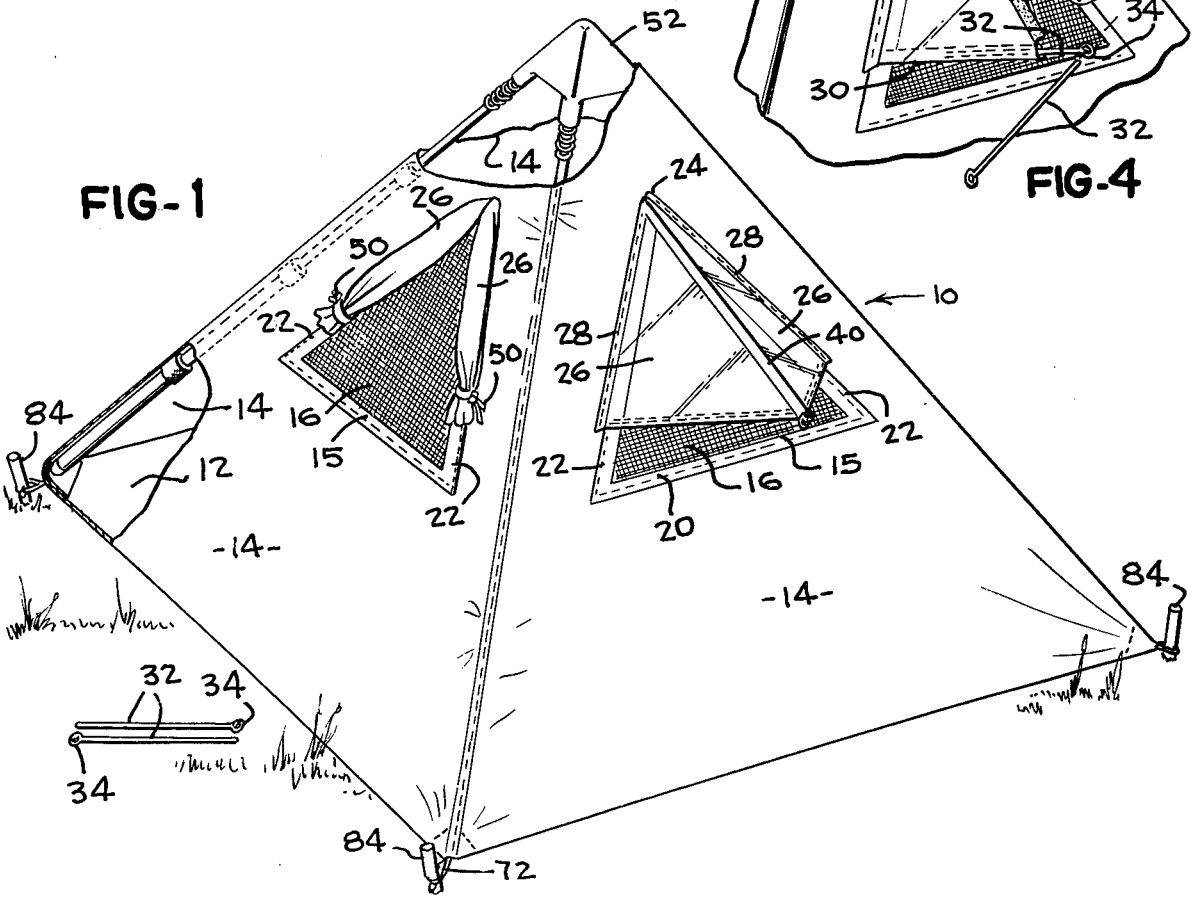

TENT

BACKGROUND OF THE INVENTION

This invention is in the field of portable shelters and the like and is more specifically directed to a flexible walled tent having an internal rigid support structure which is easily disassembled and packed into a compact bundle.

Prior known pyramidal tents or shelters having a variety of constructions have been proposed in the past. For example, prior known umbrella-type tents have a center post extending vertically upward in the center of the tent with lateral arms to engage grommets positioned in the side edges of the tent to hold the side edges outwardly between the apex of the tent and the corners of the tent which are fixed to the ground by stakes. A disadvantage of this type of construction is that the side edges are not rigidly supported and consequently tend to flap if there is a wind. Moreover, the positioning of the center post in the tent is inconvenient in that it takes up space and makes the floor less usable. Other prior known tents have employed external supporting frameworks which are difficult to assemble and disassemble and are quite bulky when the tent is packed for movement. These tents also are susceptible to flapping and wind noise. The weight and unattractive appearance of tents of the foregoing type is consequently a substantial disadvantage.

A safe positioning of a tent on the ground has been effected in the past by the provision of stakes engaged with loops along the periphery of the floor of the tent. Additional stakes have been connected to tie-down ropes connected with elevated portions of the tent with the overall arrangement requiring relatively time-consuming procedures during the erection of the tent. In all prior known instances, the stakes connecting the tent to the ground around the bottom periphery of the tent is effected by engagement of the stages with cloth loops attached to the tent fabric so that the resistance to wind forces is provided largely through cloth connectors as opposed to the stronger and more rigid supporting framework. This relationship between the parts can result in substantial concentrations of stress in cloth portions of the tent when there is substantial wind so that ripping and damage can occur.

Another prior known problem of prior tent constructions resides in the fact that windows provided in the side walls of the tents have not been capable of providing satisfactory ventilation to the interior of the tent without the windows being fully opened to also permit the entry of sunlight and/or precipitation either of which can be undesirable.

Therefore, it is the primary object of this invention to provide a new and improved tent construction.

Yet another object of the present invention is the provision of a new and improved tent construction in which tie-down members are connected directly to frame components provided on the interior of the tent.

Yet another object of the present invention is the provision of a new and improved window shade means for a tent which permits ventilation through the window while shading the window opening from precipitation and/or the entry of direct sunlight.

Obtainment of the foregoing objects of this invention is enabled through the provision of a tent shelter of pyramidal shape having a four-sided quadrilateral floor panel with triangular side walls attached thereto and defining an apex at their upper extent. A support framework is positionable within the tent and includes four flexible telescoping rods which extend along the edges of the shelter adjacent the juncture of the triangular side walls and have their upper ends received in coil spring members extending outwardly and downwardly from a pyramid shaped plastic apex member positioned in the apex of the tent. The lower end of each of the telescoping support rods receives a tie-down cord retainer plug consisting of a relatively small diameter connector portion matingly fitted in the hollow lower open end of the support rod and an outer bulbous end of greater diameter. A bore extends through the outer bulbous end and the inner coupling end of the tie-down cord retainer plug and a tie-down cord extends through the bore and has a knot provided on its inner end on the interior of the support rod. The knot prevents removal of the tie-down cord which has an opposite end externally of the tent and which cord extends through a sealed opening provided in a gusset in the corner portions of the tent defined by the juncture of two triangular side panels with one corner of the floor panel.

Additionally, at least one of the triangular walls of the tent is provided with a triangular window opening having a horizontal base edge and two inclined side edges intercepting at the upper extent of the window. An awning for the window comprises first and second triangular awning panels connected along side edges to the side edges of the window and each having a lower edge of a width greater than the length of the base edge of the triangular window. A stiffener rod is positioned in each of the triangular panels with the outer end of each stiffener rod having a loop through which the other stiffener rod can be extended so as to hold the stiffener rods connected to each other at their outer ends. Adjacent outer edges of the triangular awning panels are connected by a conventional connector means such as a Velcro fastener or by a zipper or the like so that the awning is held in position in the shape of the corner of a pyramid extending outwardly above the window opening to shade the window opening but being open at its lower extent while permitting the entry of air to the tent interior for ventilation purposes. The stiffener rods can be removed and the triangular awning side panels can be rolled upwardly and held in position adjacent the window openings if their use is not desired.

A better understanding of the manner in which the preferred embodiment of the invention is constructed will be achieved when the following detailed description is considered in conjunction with the appended drawings.

DESCRIPTION OF THE DRAWINGS

FIG. 1 is a perspective view of the preferred embodiment of this invention with portions removed for the sake of illustration;

FIG. 2 is an exploded perspective of a lower corner of the preferred embodiment illustrating tie-down frame connector means;

FIG. 3 is a bisecting sectional view of a portion of the preferred embodiment of FIG. 1 with portions removed for the sake of clarity; and FIG. 4 is a perspective view of a window awning component of the preferred embodiment illustrating the parts in a partially open condition.

DESCRIPTION OF THE PREFERRED EMBODIMENT

The preferred embodiment, generally designated 10, comprises a shelter in the form of a tent having a square floor panel 12 and four side walls 14, two of which are provided with triangular windows 16 with one of the other side walls having an entrance opening (not shown) for permitting ingress and egress to and from the tent. The side walls are joined together at their edges to define a pyramid shaped construction having an apex 18. The lower edge of the side walls is connected to the floor panel 12. The side walls may be fabricated from the frame or from different materials than those used in the floor panel. Frequently, it is desirable to employ a water impermeable material for fabrication of the floor panel in conjunction with a breathable material such as canvas for the side walls.

Windows 15 are provided with a cloth mesh covering 16 for precluding the entry of insects into the interior of the tent. The triangular window openings 15 include a horizontal bottom edge 20 and side edges 22 intersecting at an upper window peak 24. A light-transparent awning formed of first and second triangular awning panels 26 is provided over the triangular windows 15 with the panels 26 each having an inward side edge 28 connected to the side edges 22 of the window and a lower edge 30. Lower edge 30 is tubular so as to permit the insertion of stiffener rods 32 having a hook 34 on their outer ends defining an opening sufficiently large to permit the other of said rods to pass therethrough as shown in FIG. 4. Triangular awning panels 26 also include an outward edge 36 adjacent which a Velcro fastening means 38 is provided so that the Velcro fastening means 38 of the different panels cooperate to be engaged together to define an awning apex 40. The awning panels are held in their extended position shown in FIG. 1 by virtue of the connection between the Velcro connectors 38 and the connection between the ends of the stiffener rods 32 by virtue of the insertion of one of the rods through the opening in the hook portion 34 of the other rod. The awning consequently assumes the shape of the corner of the pyramid so as to shield the window openings from rain while preventing the passage of air through the openings for ventilation purposes. Additionally, it should be understood that the triangular awning panels 26, while shown in the form of transparent plastic, could also be non-transparent so as to reduce the passage of light to darken the interior of the tent while still permitting ventilation of the interior.

When it is not desired to use the awning panels, the stiffener rods 32 are removed and the panels are rolled to the sides of the window and held in position by ties 50, as shown in conjunction with the window on the left portion of the tent illustrated in FIG. 1.

An apex cap 52 formed of plastic material normally in pyramid shape is provided in the apex 18 of the erected tent and has four downwardly and outwardly extending coil members 54 formed of metal or plastic and dimensioned to define an internal opening for receiving the upper end of telescoping rod means 60 as best shown in FIG. 3. Coil members 54 extend from protrusions 56; however, protrusion 56 could be eliminated if desired. The flexible nature of the springs 54 permits the rods 60 to be folded inwardly together when the tent is collapsed so that the rods can be bundled together to occupy a minimum amount of space. It should be understood that the telescoping rods 60 are basically identical to the rods 45 of my copending application Ser. No. 937,584. Also, the apex cap 52 is basically of pyramid configuration when protrusions 56 are not used with the upper ends of the coil members 54 being cast in the pyramid shaped member.

The lower end section 62 of the telescopic support rods 60 receives a tie-down cord connector 64 formed of metal or plastic and including a cylindrical insert end 66 dimensioned to be matingly inserted in the lower end of the rod member 62 and a rounded bulbous outer end head portion 68. A bore 70 extends through the connector 64 and a tie-down cord 72 extends through the bore and is retained therein by a knot 74 on the end of the cord. Cord 72 extends outwardly through a sealed opening 76 in a location adjacent the floor corner of the tent extending through the floor panel and a reinforcing gusset 80 as best shown in FIG. 2. The outer end of the tie-down cord 72 is easily connectable to stakes 84 or the like for holding the tent in position. It will be observed that the tie-down cord 72 is directly connected to the supporting framework 60, 62 etc. so that the resistance to wind forces is provided directly to the framework rather than through fabric components of the tent as has been the case in the previous tent constructions. Thus, a uniquely strong and sturdy structure is provided by the preferred embodiment.

Numerous modifications of the preferred embodiment will undoubtedly occur to those of skill in the art and it should be understood that the spirit and scope of the invention is to be limited solely by the appended claims.

I claim:

1. A shelter comprising a flexible polygonal floor panel, a plurality of flexible triangular side walls with each having a lower edge attached to an edge of said floor panel, and edges of adjacent side walls attached together thereby forming an apex at the upper end thereof and floor corners in conjunction with the floor panel at the lower ends thereof, and a support structure including telescoping rod members positionable within the shelter along the adjoining edges of said side walls and an apex cap member formed of plastic material positionable in the apex formed by said side walls and having flexible spring members extending downwardly and outwardly therefrom for receiving and retaining upper ends of said telescoping rod members.

2. The shelter of claim 1 wherein said apex cap member is of pyramid configuration.

3. The shelter of claim 1 additionally including a tie-down cord extending through each floor corner and having an inner end connected to a retainer plug in the lower end of one of said rod members and having an outer end external of the shelter so as to be connectable to a tie-down stake or the like.

4. The shelter of claim 1 wherein one of said side walls has a triangular window opening with a horizontal bottom edge and side edges extending from opposite ends thereof and intersecting at an upper window peak, an awning formed of first and second triangular awning panels each having an inward side edge connected to one of the side edges of the window, a lower edge of a length exceeding one-half the length of the horizontal bottom edge of the window and an outer side edge, connector means for permitting the connection of said outer side edges of said awning panels to each other and stiffener rods removably connectable to the first and second triangular awning panels along the lower edges thereof and coupling means on the ends of said stiffener rods adjacent said outer side edges for coupling said stiffener rods to each other to hold the awning outwardly of and above the window.

5. The shelter of claim 4 additionally including a tie-down cord extending through each floor corner and having an inner end connected to a retainer plug in the lower end of one of said rod members and having an outer end external of the shelter so as to be connectable to a tie-down stake or the like.

6. The shelter of claim 5 wherein said apex cap member is of pyramid configuration.

7. In a shelter comprising a flexible polygonal floor panel, a plurality of flexible side walls with each having a lower edge attached to an edge of said floor panel and side edges of adjacent side walls attached together thereby forming an end thereof and floor corners, and a support structure including a rod member having a lower end positionable within the floor corner, the improvement comprising a tie-down cord extending through said floor corner and having an inner end connected to a retainer plug in the lower end of said rod member and having an outer end external of the shelter so as to be connectable to a tie-down stake or the like.

8. The invention of claim 7 wherein said rod is of tube formation on its lower end and said retainer plug comprises a cylindrical inner end matingly receivable in the tube formation and an enlarged bulbous outer end external of the rod with a bore extending lengthwise through said plug, said bore being of sufficient diameter to permit the inner end of said tie-down cord to extend therethrough to be retained therein by a knot formed adjacent the end of said tie-down cord.

* * * * *